US005097644A

United States Patent [19]

Hun

[11] Patent Number: 5,097,644

[45] Date of Patent: Mar. 24, 1992

[54] MOLD BOARD CONSTRUCTION

[76] Inventor: Chung S. Hun, No. 4, Alley 48, Lane 154, Chung Ching Rd., Taichung, Taiwan

[21] Appl. No.: 648,958

[22] Filed: Feb. 1, 1991

[51] Int. Cl.[5] ..... E04B 2/86

[52] U.S. Cl. ..... 52/426; 52/425; 52/433; 52/442

[58] Field of Search ..... 52/426, 427, 433, 437, 52/438, 442, 568, 425, 424

[56] References Cited

U.S. PATENT DOCUMENTS 1,014,416 1/1912 Schweikert ..... 52/425
1,180,472 4/1916 Clark ..... 52/437
1,836,398 12/1931 Roberts ..... 52/427
2,234,797 3/1941 Burner ..... 52/427
4,669,234 6/1987 Wilnau ..... 52/426

*Primary Examiner*—Michael Safavi
*Attorney, Agent, or Firm*—Browdy and Neimark

[57] ABSTRACT

A mold board construction includes a body made of concrete and a number of steel wires embedded in the body. A number of grooves are formed in the surfaces of the body so that a number of protrusions are formed on the body, and a number of holes are formed in the body so that the body can be fixed to the strips. A number of mold board constructions form a hollow space for receiving an amount of concrete so that an object is formed. The mold board constructions form part of the object.

2 Claims, 5 Drawing Sheets

MOLD BOARD CONSTRUCTION

BACKGROUND OF THE INVENTION (a) Field of the Invention

The present invention relates to a mold board, and more particularly to a mold board construction.

(b) Description of the Prior Art

Mold boards are necessary and required for constructing an object, such as a building, a bridge or a dam etc. The mold boards are generally made of wood and are fixed in place by nails. For example, when a post of a building is to be constructed, the mold boards are fixed so that a hollow space for forming the post is formed within the mold boards and so that concrete can be filled within the hollow space. After aging and after the concrete is solidified, the mold boards should be removed from the post.

It is time consuming to fix and to remove the mold boards, and to treat the removed mold boards. In addition, the mold boards generally will be damaged when removed so that the mold boards can be used for once or twice only, this costs a lot of money. Furthermore, the damaged mold boards cause pollution problems. And particularly, the nails are still fixed on the mold boards when the mold boards are removed so that people, especially the workers will be hurt by the nails.

The present invention has arisen to mitigate and/or obviate the afore-described disadvantages of the conventional mold boards.

SUMMARY OF THE INVENTION

The primary objective of the present invention is to provide a mold board construction which becomes part of the object to be constructed and which does not need to be removed after the object is constructed.

Another objective of the present invention is to provide a mold board construction in which object to be constructed can be reinforced by the mold board construction.

In accordance with one aspect of the invention, there is provided a mold board construction which includes a body made of concrete and a number of steel wires embedded in the body. A number of grooves are formed in the surfaces of the body so that a number of protrusions are formed on the body, and a number of holes are formed in the body so that the body can be fixed to the strips. A number of mold board constructions form a hollow space for receiving an amount of concrete so that an object is formed. The mold board constructions form part of the object.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
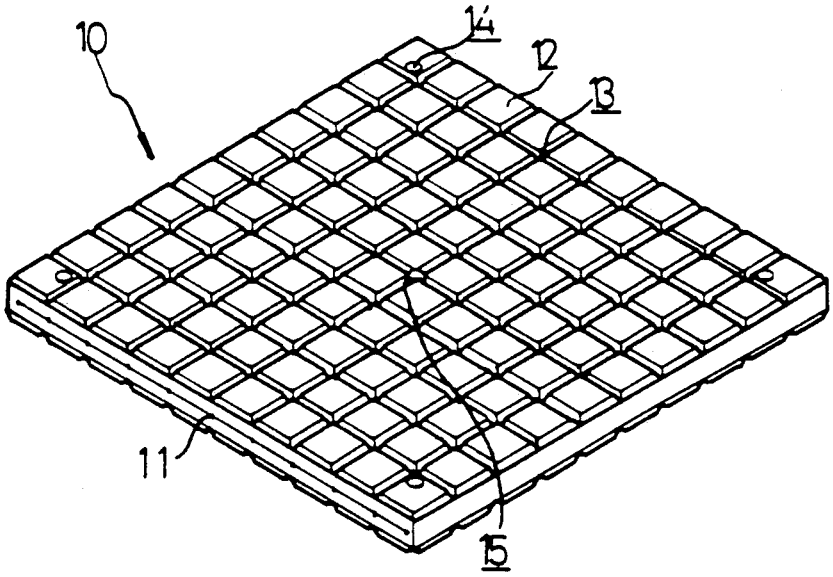
FIG. 1 is a perspective view of a mold board construction is accordance with the present invention.
Figure 2:
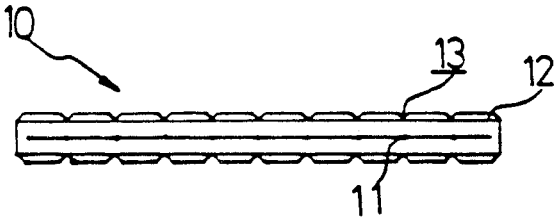
FIG. 2 is a side view of the mold board construction.

Referring to the drawings and initially to FIGS. 1 and 2, a mold board construction 10 in accordance with the present invention is generally made by a molding method and comprises a plurality of steel wires or steel bars 11 embedded within the body thereof. A plurality of slots or grooves 13 are longitudinally and laterally formed on both surfaces of the mold board construction 10 so that a plurality of block type protrusions 12 are formed thereon. Four holes 14 are formed in the corner areas and one hole 15 is formed in the center of the mold board construction 10.

Figure 3:
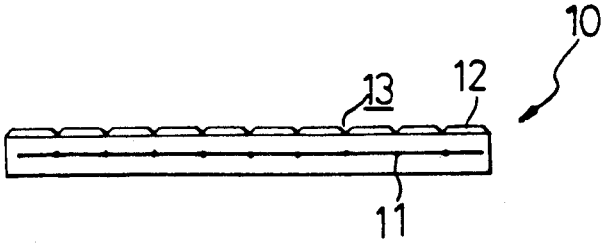
FIG. 3 is a side view illustrating another embodiment of the mold board construction.

Referring next to FIG. 3, alternatively, only one surface of the mold board construction 10 has grooves 13 and protrusions 12 formed thereon. The other surface of the mold board construction 10 is smooth and flat.

Figure 4:
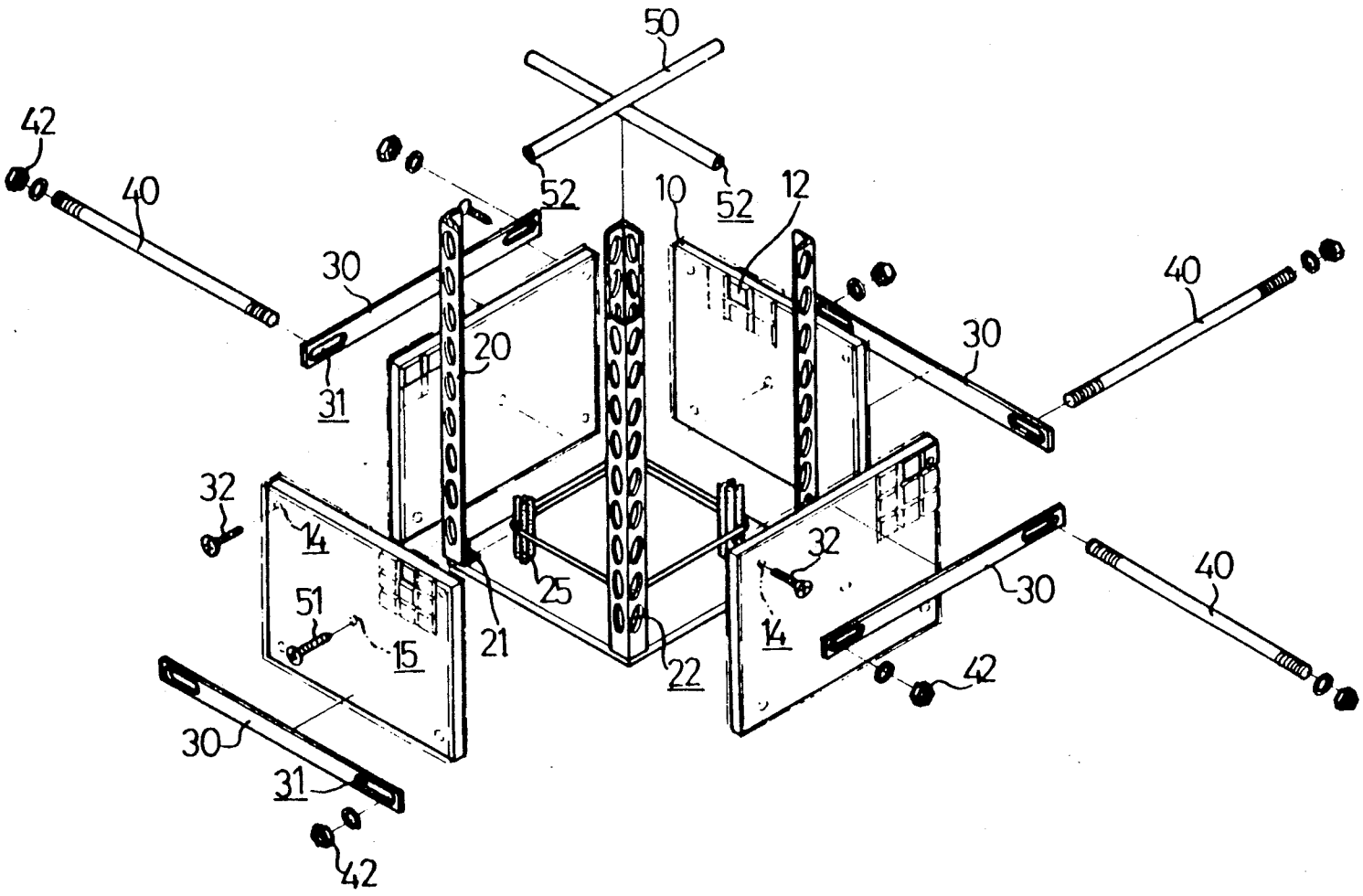
FIG. 4 is an exploded view of an object to be constructed with the mold board construction.
Figure 5:
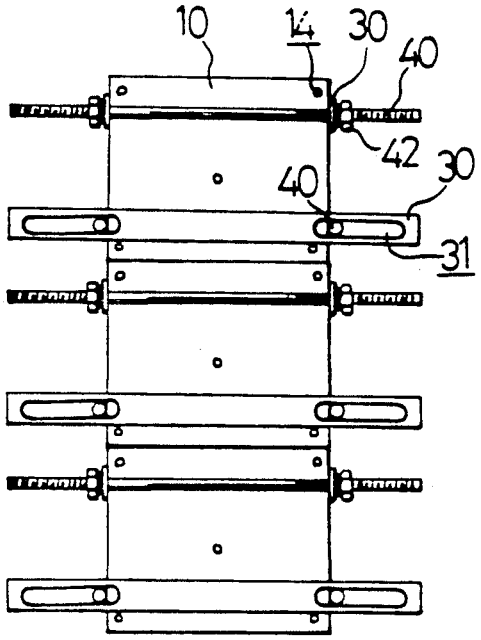
FIG. 5 is a plane view of the object with the mold board construction fixed thereon.
Figure 6:
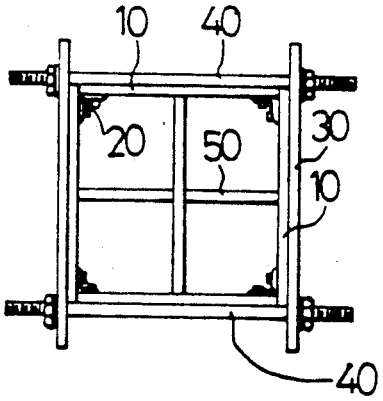
FIG. 6 is an upper view of the object.

Referring next to FIGS. 4, 5 and 6, for example, when an object, such as a post is to be constructed with the mold board construction 10 in accordance with the present invention, four steel strips, such as angle steels 20 are vertically fixed to the ground surface by small angle steels 21 and are distributed on the corner areas of the hollow space for forming the post. A plurality of holes 22 are formed in the angle steels 20. A plurality of steel bars 25 are arranged within the hollow space. The mold board construction 10 is fixed to the angle steels 20 by screws or bolts 32 which pass through the holes 14 and 22 and which can be fixed by nuts. Alternatively, the hole 22 is a screw hole so that the bolts 32 can be directly engaged therewith.

A rod 50 which has a screw hole 52 formed in each end thereof can be fixed between every two opposite mold board constructions 10 by screws 51 which pass through the hole 15 of the mold board construction 10 so that the mold board constructions 10 can further be solidly fixed in place. A pair of frame plates 30 which have an oblong hole 31 formed in each end thereof are provided on the outer sides of every two opposite mold board constructions 10 and are fixed together by bolts 40 and nuts 42 so that the mold board constructions 10 can further be retained in place. When the hollow space is enclosed by the mold board constructions 10, the hollow space can be filled with concrete. The concrete fills within the grooves 13 of the mold board constructions 10 so that the mold board constructions 10 can be adhered or fixed integrally with the concrete after the concrete is solidified. After the concrete is solidified, only the frame plates 30 are required to be removed. The mold board constructions 10 form a part of the post so that they do not need to be removed. When grooves 13 are formed in the outer surface of the mold board construction 10, tiles can be integrally fixed to the outer surface of the mold board construction 10 because concrete can be filled within the grooves 13. When no grooves 13 are formed, the smooth outer surface directly forms the outer surface of the object and no finishing coating processes are required.

Alternatively, the mold board constructions 10 can be formed with suitable curvature so that a cylindrical post can be constructed with curved mold board constructions 10.

Figure 7:
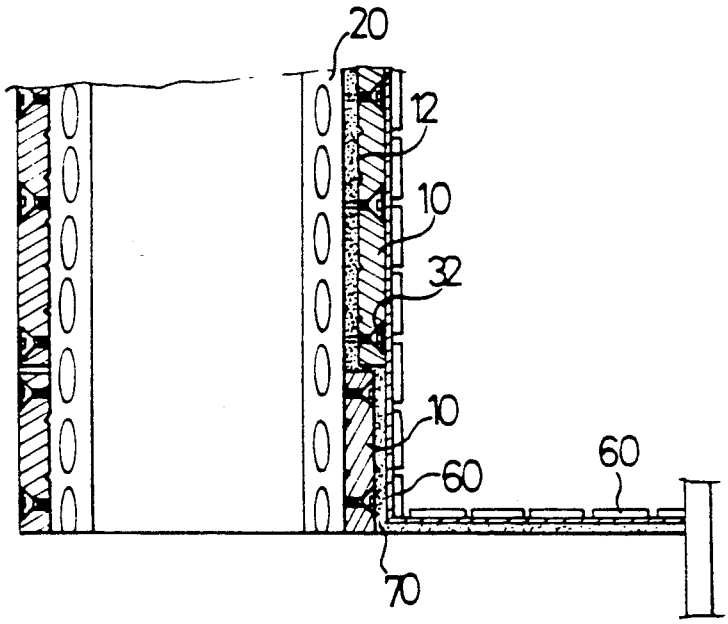
FIGS. 7 and 8 are partial cross sectional views of the other objects constructed with the mold board construction.
Figure 8:
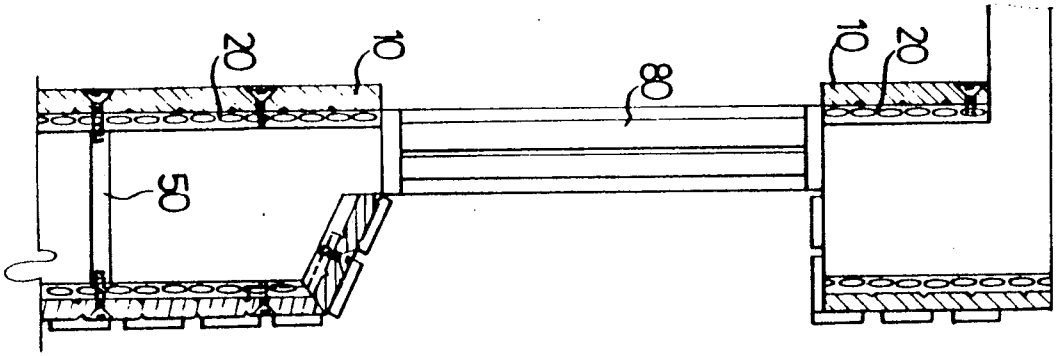

Referring next to FIGS. 7 and 8, illustrated are two applications of the present invention. As shown in FIG. 7, the wall portions of a bathroom can also be constructed with the mold board constructions 10. A layer of water proof material 70 is disposed before the tiles 60 are fixed to the wall portions of the bathroom. As shown in FIG. 8, an opening for disposing a window 80 can be formed when the wall portion of a building or the like is constructed with the mold board constructions 10 so that the window 80 can be easily fixed in place within the opening.

Accordingly, the mold board construction 10 in accordance with the present invention forms part of the object and does not need to be removed, so that, when constructing the object, the environment is clean and no pollution problems. The object is reinforced by the mold board constructions, and no further finishing coating processes are required.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An object comprising:

a plurality of strips integrally fixed to a ground surface so that a hollow space for forming said object is formed among said strips, a plurality of first screw holes being formed in said strips:

four mold board constructions fixed to said strips so as to form two pairs of opposite mold board constructions, each of said mold board constructions including a body made of concrete and a plurality of steel wires embedded in said body, a plurality of grooves being formed in at least one surface of said body so that a plurality of protrusions are formed on said body, and a plurality of holes being formed in said body, and a plurlality of bolts passing through said first screw holes of said strips and said holes of said body so that said body can be fixed to said strips;

a rod being provided between every pair of said opposite mold board constructions, a second screw hole being formed in each end of said rod, a second bolt passing through one of said hole and being threadedly engaged to said second screw hole of said rod so that said opposite mold board constructions can further be integrally coupled together; and an amount of concrete being filled within said hollow space, said concrete being filled within said grooves of said body so that said body is integrally fixed with said concrete, so that said mold board construction forms part of said object and so that said mold board construction need not to be removed.

2. An object according to claim 1, wherein a pair of frame plates are provided beside every pair of said opposite mold board constructions before said concrete is filled within said hollow space, an oblong hole is formed in each end of each of said frame plates, said frame plates are integrally coupled together by bolts which pass through said oblong holes so that said mold board construction can further be retained in place when said concrete is filled within said hollow space.

* * * * *